US007140920B1

(12) United States Patent
Lin

(10) Patent No.: US 7,140,920 B1
(45) Date of Patent: Nov. 28, 2006

(54) ELECTRIC PLUG

(76) Inventor: Vincent Lin, No. 39, Sec. 3, Chung-Hua Road, Hsin-Chu City (TW)

( * ) Notice: Subject to any disclaimer, the term of this patent is extended or adjusted under 35 U.S.C. 154(b) by 0 days.

(21) Appl. No.: 11/412,133

(22) Filed: Apr. 27, 2006

(51) Int. Cl.
*H01R 13/66* (2006.01)

(52) U.S. Cl. ..... 439/620.3; 439/620.21; 439/620.04; 439/620.26

(58) Field of Classification Search ..... 439/620.26, 439/620.3, 620.04, 620.21; 337/198
See application file for complete search history.

(56) References Cited

U.S. PATENT DOCUMENTS 4,345,223 A * 8/1982 Chien-Chun ..... 439/620.3
5,002,501 A * 3/1991 Tucker ..... 439/620.26
5,034,846 A * 7/1991 Hodge et al. ..... 439/620.3
5,451,173 A * 9/1995 Mai ..... 439/620.29
6,753,755 B1 * 6/2004 Montague ..... 337/265

* cited by examiner

*Primary Examiner*—Briggitte R. Hammond
(74) *Attorney, Agent, or Firm*—Pillsbury Winthrop Shaw Pittman LLP

(57) ABSTRACT

An electric plug includes: a housing; a mounting seat mounted in the housing and having two opposite side walls, a U-shaped transverse wall interconnecting the side walls and defining a resistor-receiving recess, and a partition wall cooperating with the side walls to define two opposite fuse-receiving grooves, the mounting seat further having two wings that cooperate with the side walls to define two opposite prong-receiving grooves; a pair of prongs extending through the prong-receiving grooves and provided with protrusions that extend through the side walls and into the fuse-receiving grooves; a voltage-limiting component mounted in the resistor-receiving recess and having a pair of conductive clamping members extending into the fuse-receiving grooves, respectively; and a pair of fuses clamped by the clamping members and extending into the fuse-receiving grooves to contact the prongs.

3 Claims, 3 Drawing Sheets

ELECTRIC PLUG

CROSS-REFERENCE TO RELATED APPLICATION

This application claims priority of Chinese Application No. 200620000426.8, filed on Jan. 5, 2006.

1. FIELD OF THE INVENTION

The invention relates to an electric plug, more particularly to an electric plug for a Christmas lamp string that includes light-emitting-diode (LED) light bulbs.

2. DESCRIPTION OF THE RELATED ART

With the advantages of low power consumption, low heat dissipation and long service life, use of light emitting diodes as the light source for a lamp string has been proposed. However, light-emitting diodes have polar property. Hence, they are not suitable for direct use with an alternating current power source. In addition, light-emitting diodes tend to be damaged under an unstable voltage.

SUMMARY OF THE INVENTION

Therefore, the object of the present invention is to provide an electric plug to overcome the above drawbacks associated with the prior art.

Accordingly, an electric plug of the present invention, comprises: a housing; a mounting seat mounted in the housing and having a front wall, two opposite side walls extending rearwardly from the front wall, a U-shaped transverse wall interconnecting the side walls and defining a resistor-receiving recess, and a partition wall disposed between the side walls, extending between the front wall and the U-shaped transverse wall, and cooperating with the side walls to define two opposite fuse-receiving grooves, each of the side walls being formed with a notch, the mounting seat further having a pair of wings that extend outwardly and respectively from and that cooperate with the side walls to define two opposite prong-receiving grooves; a pair of prongs, each of which extends outwardly of the housing through a respective one of the prong-receiving grooves, and each of which is provided with a protrusion that extends through the notch in a respective one of the side walls and into a respective one of the fuse-receiving grooves; a voltage-limiting component mounted in the resistor-receiving recess and having a pair of conductive clamping members extending into the fuse-receiving grooves, respectively; and a pair of fuses, each of which is clamped by a respective one of the clamping members and each of which extends into a respective one of the fuse-receiving grooves to contact the protrusion of a respective one of the prongs.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
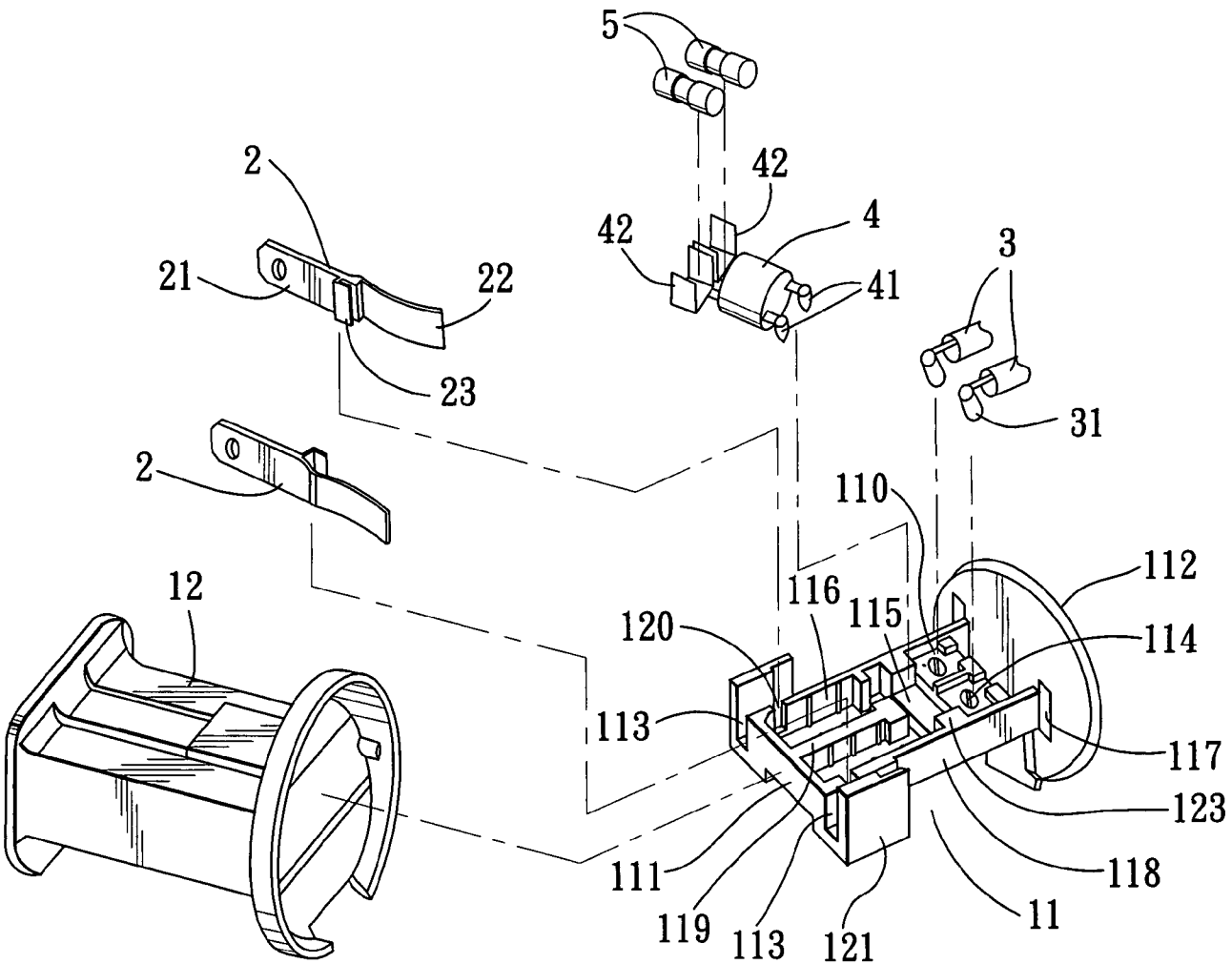
FIG. 1 is an exploded perspective view of the preferred embodiment of an electric plug according to the present invention.
Figure 2:
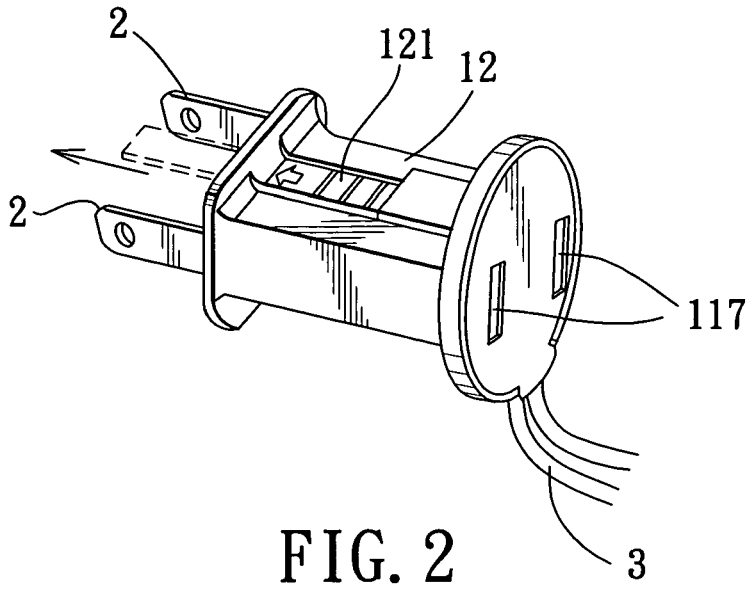
FIG. 2 is an assembled perspective view of the preferred embodiment.
Figure 3:
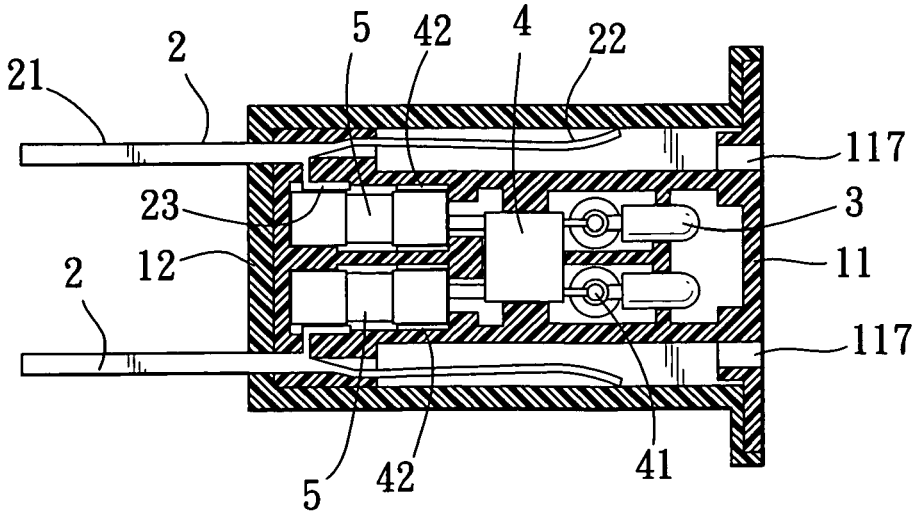
FIG. 3 is an assembled sectional view of the preferred embodiment.

Referring to FIGS. 1 to 3, the preferred embodiment of an electric plug according to the present invention is shown to comprise: a housing 12; a mounting seat 11 mounted in the housing 12 and having a front wall 111, two opposite side walls 118 extending rearwardly from the front wall 111, a U-shaped transverse wall 123 interconnecting the side walls 118 and defining a resistor-receiving recess 115, and a partition wall 119 disposed between the side walls 118, extending between the front wall 111 and the U-shaped transverse wall 123, and cooperating with the side walls 118 to define two opposite fuse-receiving grooves 116, each of the side walls 118 being formed with a notch 120, the mounting seat 11 further having a pair of wings 121 that extend outwardly and respectively from and that cooperate with the sidewalls 118 to define two opposite prong-receiving grooves 113; a pair of prongs 2, each of which extends outwardly of the housing 12 through a respective one of the prong-receiving grooves 113, and each of which is provided with a protrusion 23 that extends through the notch 120 in a respective one of the side walls 118 and into a respective one of the fuse-receiving grooves 116; a voltage-limiting component 4, such as a resistor, mounted in the resistor-receiving recess 115 and having a pair of conductive clamping members 42 extending into the fuse-receiving grooves 116, respectively; and a pair of fuses 5, each of which is clamped by a respective one of the clamping members 42 and each of which extends into a respective one of the fuse-receiving grooves 116 to contact the protrusion 23 of a respective one of the prongs 2.

Figure 4:
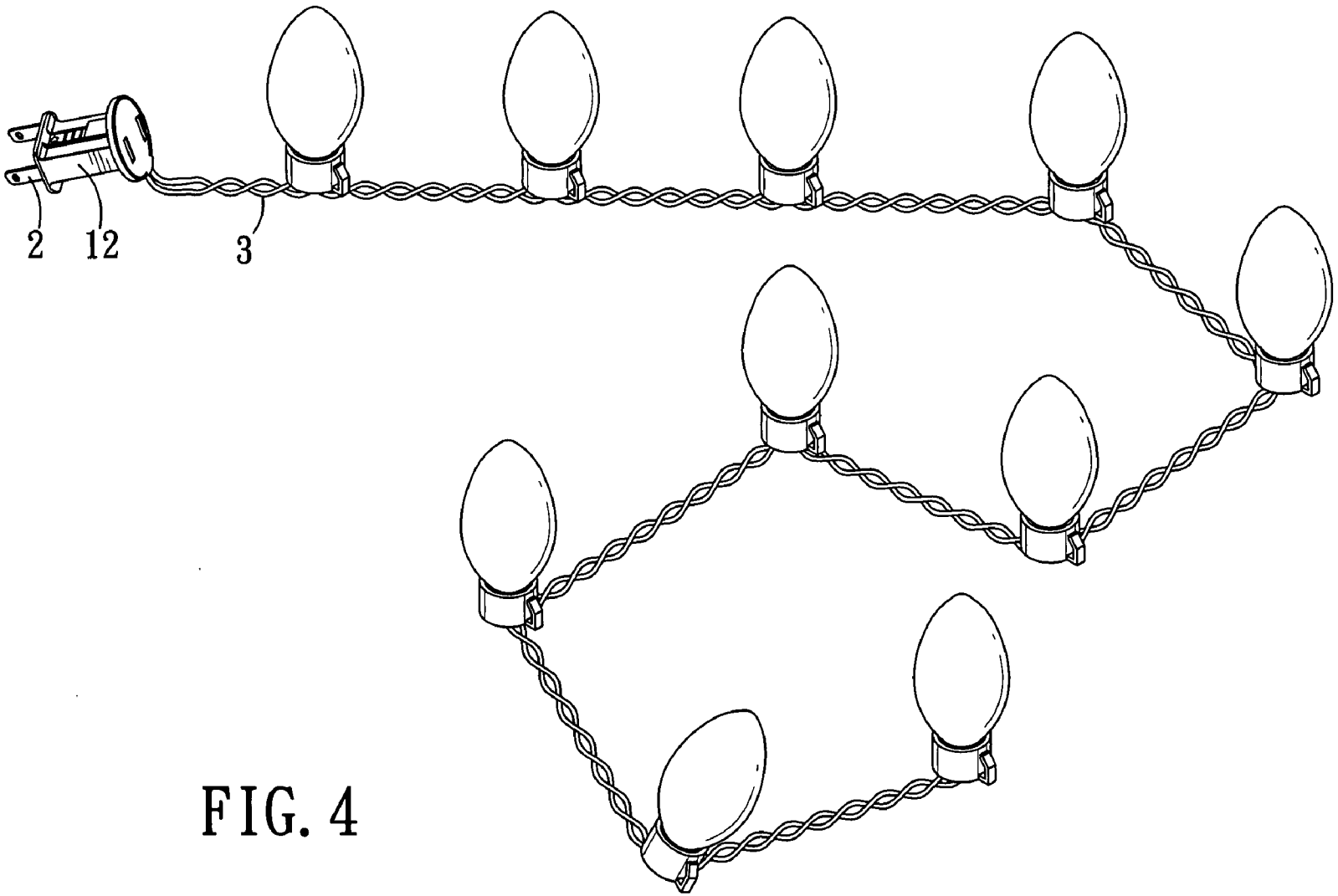
FIG. 4 is a perspective view of the preferred embodiment applied to a lamp string.

In this embodiment, the protrusion 23 of each of the prongs 2 is L-shaped. Each of the prongs 2 includes a plug end portion 21 for plugging into a socket of an alternating current power supply (not shown). The mounting seat 11 further has a rear transverse wall 110 that extends between the side walls 118 and that is formed with two opposite retaining holes 114. The electric plug further includes a pair of conductive wires 3, each of which is provided with an annular clamper 31 that is fitted into a respective one of the retaining holes 114. In this embodiment, the clampers 31 are made from copper, and are punched into a cup shape. The wires 3 are connected to a lamp string having a plurality of light-emitting diode light bulbs, as best shown in FIG. 4. The voltage-limiting component 4 further has a pair of conductive inserts 41, each of which is clamped by the annular clamper 31 of a respective one of the conductive wires 3.

In operation, when the plug end portions 21 of the prongs 2 are plugged into a socket of an alternating current power supply, the voltage-limiting component 4 operates to limit current and voltage of the lamp string. The fuses 5 provide protection for the light bulbs of the lamp string from burning out.

The housing 12 is formed with an access opening for access to the fuses 5 in the fuse-receiving grooves 116, and is provided with a movable cover 121 for covering the access opening.

The mounting seat 11 further has a rear wall 112 that is disposed on an exterior of the housing 12, and that is formed with a pair of slots 117 for extension of prongs of a plug of another lamp string therein. Each of the prongs 2 further has a rear end portion 22 extending from the plug end portion 21 for contacting the prongs of the plug of another lamp string inserted through the slots 117 into the housing 12.

Optionally, a rectifier (not shown) for converting an alternating current power signal into a direct current power signal can be incorporated in the electric plug of this invention.

With the inclusion of the voltage-limiting component 4 and the fuses 5 in the electric plug of this invention, the aforesaid drawbacks associated with the prior art can be eliminated.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. An electric plug comprising:

a housing;

a mounting seat mounted in said housing and having a front wall, two opposite side walls extending rearwardly from said front wall, a U-shaped transverse wall interconnecting said side walls and defining a resistor-receiving recess, and a partition wall disposed between said side walls, extending between said front wall and said U-shaped transverse wall, and cooperating with said side walls to define two opposite fuse-receiving grooves, each of said side walls being formed with a notch, said mounting seat further having a pair of wings that extend outwardly and respectively from and that cooperate with said side walls to define two opposite prong-receiving grooves;

a pair of prongs, each of which extends outwardly of said housing through a respective one of said prong-receiving grooves, and each of which is provided with a protrusion that extends through said notch in a respective one of said side walls and into a respective one of said fuse-receiving grooves;

a voltage-limiting component mounted in said resistor-receiving recess and having a pair of conductive clamping members extending into said fuse-receiving grooves, respectively; and a pair of fuses, each of which is clamped by a respective one of said clamping members and each of which extends into a respective one of said fuse-receiving grooves to contact said protrusion of a respective one of said prongs.

2. The electric plug as claimed in claim 1, wherein said protrusion of each of said prongs is L-shaped.

3. The electric plug as claimed in claim 1, wherein said mounting seat further has a rear transverse wall that extends between said side walls and that is formed with two opposite retaining holes, said electric plug further comprising a pair of conductive wires, each of which is provided with an annular clamper that is fitted into a respective one of said retaining holes, said voltage-limiting component further having a pair of conductive inserts, each of which is clamped by said annular clamper of a respective one of said conductive wires.

* * * * *